US005511883A

United States Patent [19]

Clark et al.

[11] Patent Number: 5,511,883

[45] Date of Patent: Apr. 30, 1996

[54] HANG TAB FOR CONTAINERS

[75] Inventors: John Clark, Hoffman Estates; Karl Hoffman, Arlington Heights, both of Ill.

[73] Assignee: Plitek, L.L.C., Des Plaines, Ill.

[21] Appl. No.: 366,020

[22] Filed: Dec. 29, 1994

Related U.S. Application Data

[63] Continuation of Ser. No. 29,530, Mar. 11, 1993, abandoned.

[51] Int. Cl.[6] ..... B65D 33/14

[52] U.S. Cl. ..... 383/22; 383/25; 383/82; 206/806; 206/813

[58] Field of Search ..... 383/11, 22, 9, 383/25, 78, 81, 82, 83; 206/806, 813

[56] References Cited

U.S. PATENT DOCUMENTS

| | | | |
|---|---|---|---|
| 168,536 | 10/1875 | Snow | 383/22 |
| 172,759 | 1/1876 | Mentzel | 383/22 |
| 599,219 | 2/1898 | Bunker . | |
| 1,079,527 | 11/1913 | Wallace . | |
| 1,128,192 | 2/1915 | Smith . | |
| 1,254,966 | 1/1918 | Bens . | |
| 2,355,786 | 8/1944 | Dreher et al. . | |
| 2,394,335 | 2/1946 | Shapiro . | |
| 2,846,134 | 8/1958 | Moubayed | 383/25 |
| 2,861,735 | 11/1958 | Faltin . | |
| 3,109,578 | 11/1963 | Davis | 383/11 |
| 3,142,436 | 7/1964 | Heigl . | |
| 3,147,673 | 9/1964 | Hilton . | |
| 3,806,024 | 4/1974 | Marchesani . | |
| 4,103,952 | 8/1978 | Thompson . | |
| 4,261,506 | 4/1981 | Scott . | |
| 4,638,912 | 1/1987 | Graf . | |
| 4,846,586 | 7/1989 | Bruno . | |
| 4,953,708 | 9/1990 | Beer et al. . | |
| 4,997,104 | 3/1991 | Pohl . | |
| 5,078,509 | 1/1992 | Center et al. . | |

FOREIGN PATENT DOCUMENTS

| | | | |
|---|---|---|---|
| 1594845 | 7/1970 | France . | |
| 7408416 | 10/1975 | France . | |
| 2521042 | 11/1976 | Germany | 383/25 |
| 812381 | 4/1959 | United Kingdom | 383/78 |

*Primary Examiner*—Stephen P. Garbe
*Attorney, Agent, or Firm*—Hill, Steadman & Simpson

[57] ABSTRACT

A hang tab for hanging packages from a display rack having a lower portion secured to the package and an upper portion extending above the package, the upper portion having an aperture therethrough for hanging the package and an adhesive layer covered by a release layer for re-securing the package after first use. For re-sealing the package, the release layer is removed, the package is folded-over across an open top end and the adhesive layer is secured to a lower body area of the package.

3 Claims, 1 Drawing Sheet

HANG TAB FOR CONTAINERS

This is a continuation of application Ser. No. 08/029,530, filed Mar. 11, 1993, now abandoned.

BACKGROUND OF THE INVENTION

The present invention relates to a hang tab for securing to a container, such as a bag, which serves both as a fixture for hanging the container and for resealing the container after the container has been opened. In particular, the invention relates to a hang tab adhesively secured to one side of a bag which can be folded over and secured to a side panel of the bag to resecure the bag after a first opening.

Flaps having adhesive disposed thereon for securing an open top of a bag in a folded-over condition for closure are known. Also, hang tabs adhesively attached to a bag panel for hanging the bag for display are known.

Hang tabs can be used for hanging packages. Alternatively, the package themselves can have an aperture therethrough for hanging the package on a display spindle in a store. However, the package may need to be reinforced at the aperture which can be wasteful of materials.

It is not known to provide an adhesively attached hang tab to a bag which provides an aperture for hanging the bag on a display rod and also provides on the hang tab an adhesive surface for re-closing the bag once opened for first usage.

SUMMARY OF THE INVENTION

It is an object of the present invention to provide a hang tab which serves two functions, that is, to provide an easily attachable means to suspend a bag from a display rod and also to provide on the hang tab a means for re-closing the bag after first usage.

The hang tab provides on one surface along its length an adhesive layer. The hang tab can then be adhesively secured at a first region to a top portion of the bag and can extend above the bag in a second region where an adhesive portion is covered by a release layer. Through this second region an aperture is formed for suspending the bag from a display rod. The lower region of the adhesive can also be covered by a release layer which can be removed to attach the hang tab to the bag prior to hanging the bag on the display rod.

A gap can be provided between the adhesive of the first region and the adhesive portion of the second region to allow the tab to extend upward an incremental distance from the top of the bag without adhesive. This gap prevents wasting adhesive along the complete length of the hang tab, and prevents exposed adhesive which can become attached to undesired objects such as debris or other bags.

Once opened, the bag can be resecured in a closed state by folding the top of the bag downward, removing the release layer and pressing the uncovered adhesive layer to a panel of the bag either on a front side thereof or wrapped around to be pressed to a back side thereof.

DETAILED DESCRIPTION OF THE PREFERRED EMBODIMENTS

Figure 1:
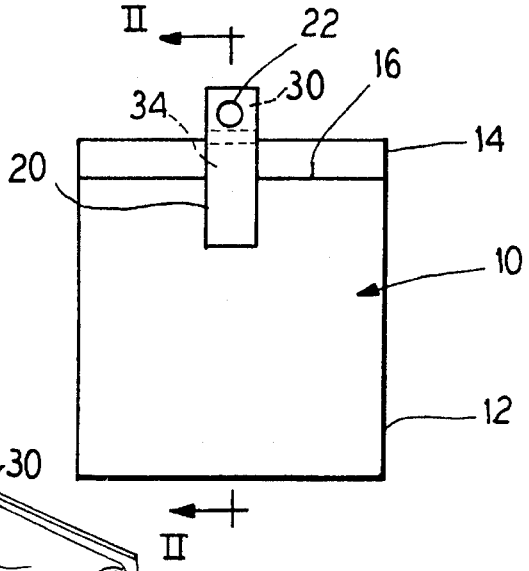
FIG. 1 is an elevational view of a back side of a bag attached to the hang tab of the present invention.

FIG. 1 shows a container such as a bag 10 having a compartment 12 on a lower end thereof and a sealing region 14 on an upper end thereof. Although the container is illustrated as a bag, other containers such as boxes, envelopes, pouches, etc. are encompassed by the present invention. The compartment provides a front panel 12*a* and rear panel 12*b*. A line 16 divides the sealing region 14 and the compartment 12 and can be a line of perforations or a tear line for opening the bag. A hang tab 20 is provided adhesively attached to the rear panel 12*b* of the bag 10. The hang tab 20 could alternately be connected to the bag 10 by other means or formed with the bag. The hang tab 20 provides an aperture 22 through a top end thereof. The hang tab 20 can be adhesively secured to either the rear panel 12*b* or the sealing region 14 or both areas.

Figure 2:
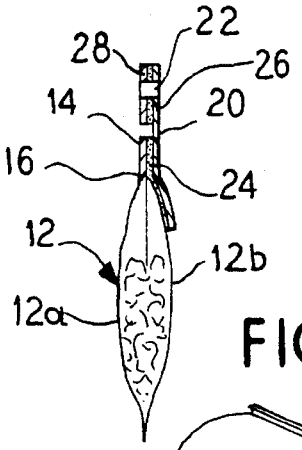
FIG. 2 is a sectional view taken generally along line II—II of FIG. 1.
Figure 4:
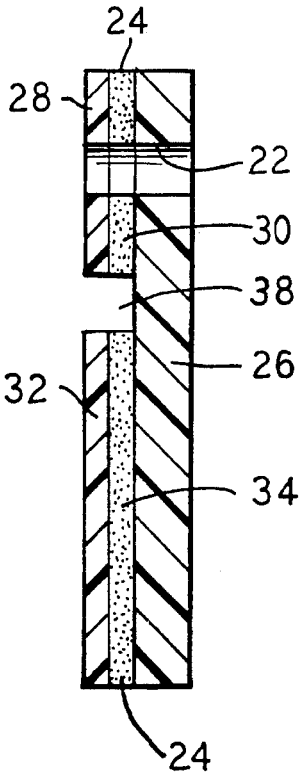
FIG. 4 is a sectional view taken generally through line IV—IV of FIG. 3.

As shown in FIG. 2 and FIG. 4, the hang tab 20 has an adhesive layer 24 applied on a body panel 26 of the hang tab 20 arranged between the bag 10 and the hang tab 20 for adhesively securing the hang tab 20 to the bag. The adhesive layer 24 can comprise a pressure sensitive adhesive material. The adhesive layer 24 is shown to be discontinuous, limited below to the compartment 12. However, the adhesive layer 24 could be continuous along the length of the body 20.

Figure 3:
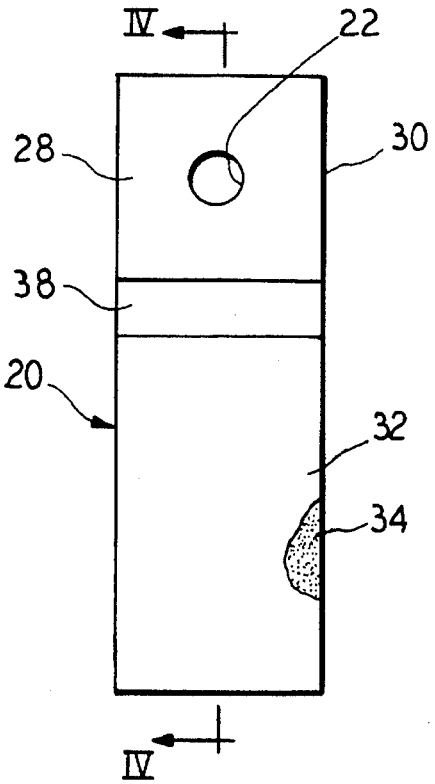
FIG. 3 is a front elevational view of the hang tab of the present invention.

FIG. 3 shows the hang tab 20 isolated from the bag 10 of FIG. 1. A release layer 28, such as a paper or plastic covering, covers an upper adhesive region 30 of the adhesive layer 24. A second release layer 32 covers a lower adhesive region 34 of the adhesive layer 24.

As shown in FIGS. 3 and 4, a gap 38 can be provided between the upper adhesive region 30 and the lower adhesive region 34. This gap 38 is provided to separate the lower adhesive region 34 from the upper adhesive region 30 so that the lower adhesive region 34 can be glued to the bag 10 and the gap portion 38 can extend above the bag, spacing the upper adhesive region 30 above the bag without wasting adhesive or exposing any adhesive unnecessarily.

The tab as shown in FIGS. 3 and 4 can be quickly secured to a bag by removing the release layer 32 and fastening the adhesive layer of the lower region 34 to the bag. The upper region 30 which provides the aperture 22 extends above the bag 10 and the tab 20 can therefore be threaded onto a display rod such as in a store.

Figure 5:
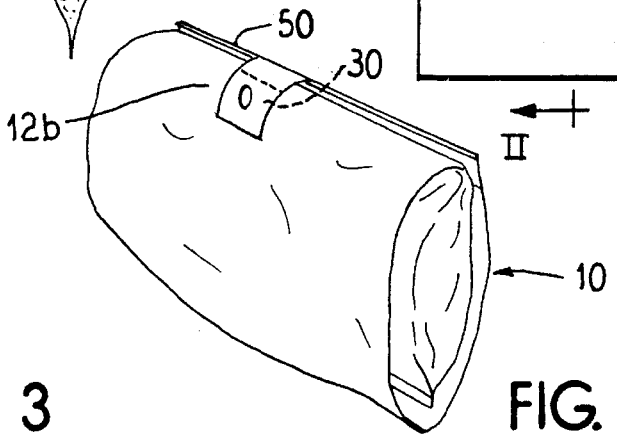
FIG. 5 is a perspective view of the bag of FIG. 1 in reclosed condition.

The resecuring of the bag 10 after opening is demonstrated in FIG. 5. When the bag is opened such as along the line 16, articles can be removed from the bag from an opened mouth 50 with the hang tab 20 remaining attached to the bag. When the bag is to be resecured, the bag is folded-over and the release layer 28 is removed and the upper adhesive layer 30 is pressed to either the front panel 12*a* or wrapped around and secured to the rear panel 12*b* of the bag 10.

Although the present invention has been described with reference to a specific embodiment, those of skill in the art will recognize that changes may be made thereto without departing from the scope and spirit of the invention as set forth in the appended claims.

We claim:

1. A package for holding articles on a display rack in a retail outlet, comprising:

a pouch for holding the articles having a sealed top end;

a hang tab secured to said pouch and having a tab portion extending above said pouch, said hang tab having an adhesive portion applied to said tab portion and a release layer covering said adhesive portion, and an aperture penetrating said tab portion.

2. The package according to claim 1, wherein said hang tab is secured to said pouch by a second portion of adhesive applied between a lower portion of said hang tab and said pouch.

3. The package according to claim 2 wherein said adhesive portion and said second portion of adhesive are separated by a gap along said hang tab, said gap devoid of adhesive.

* * * * *